US011337496B2

(12) United States Patent
Jane

(10) Patent No.: US 11,337,496 B2
(45) Date of Patent: May 24, 2022

(54) JEWELRY COMBINATION

(71) Applicant: Xander Jane Ltd., Vancouver (CA)

(72) Inventor: Alexander Jane, Vancouver (CA)

(73) Assignee: Xander Jane Ltd., Vancouver (CA)

( * ) Notice: Subject to any disclaimer, the term of this patent is extended or adjusted under 35 U.S.C. 154(b) by 0 days.

(21) Appl. No.: 16/917,602

(22) Filed: Jun. 30, 2020

(65) Prior Publication Data

US 2021/0401130 A1 Dec. 30, 2021

(51) Int. Cl.
*A44C 15/00* (2006.01)
*A44C 25/00* (2006.01)

(52) U.S. Cl.
CPC ..... *A44C 15/005* (2013.01); *A44C 25/001* (2013.01)

(58) Field of Classification Search
CPC ... A44C 15/005; A44C 25/001; A44C 25/005; A44C 25/007; A44C 17/0208; A44C 17/0233
See application file for complete search history.

(56) References Cited

U.S. PATENT DOCUMENTS 5,097,679 A * 3/1992 Johnson ..... A44C 13/00 63/23
2008/0078206 A1* 4/2008 Wright ..... A44C 25/001 63/13
2013/0067954 A1* 3/2013 Cook ..... A44C 25/001 63/4
2014/0212856 A1* 7/2014 Liberman ..... A44C 15/005 434/247

OTHER PUBLICATIONS

Photographs of pendant and chain, 2019.

* cited by examiner

*Primary Examiner* — Jack W Lavinder
(74) *Attorney, Agent, or Firm* — Oyen Wiggs Green & Mutala LLP

(57) ABSTRACT

A jewelry combination comprising: a necklace; a pendant hanging from the necklace, wherein: the pendant comprises a body and a necklace guide mounted within the body: the necklace guide has a first side, a second side opposed to the first side, and a bearing surface extending from the first side to the second side; the necklace enters the body of the pendant, passes along the first side of the necklace guide, around the bearing surface of the necklace guide, along the second side of the necklace guide, and exits the body of the pendant; the bearing surface is configured to allow the necklace to freely slide around the necklace guide; a first strand having a first end attached to the pendant at a point along a first axis, wherein the first axis intersects the necklace where the necklace passes along the first side of the necklace guide; a second strand having a first end attached to the pendant at a point along a second axis, wherein the second axis intersects the necklace where the necklace passes along the second side of the necklace guide; and wherein the first axis is substantially parallel to the second axis.

19 Claims, 10 Drawing Sheets

JEWELRY COMBINATION

TECHNICAL FIELD

The present disclosure is directed to jewelry. More particularly, the present disclosure is directed to jewelry combinations of necklaces and pendants.

BACKGROUND

Jewelry is frequently worn by individuals to adorn their bodies and clothing. In particular, pendants hung from necklaces are frequently worn for functional and/or ornamental purposes.

Necklaces are closed loops of material worn around an individual's neck. Necklaces commonly comprise ornamental materials such as metal, fiber, and synthetic materials. Pendants are hung from necklaces. An individual may wear a combination of a necklace and a pendant (a jewelry combination) by wearing the necklace around their neck and hanging the pendant from the necklace.

Pendants hung from necklaces may sway and/or twist when an individual wearing the jewelry combination moves about.

There is a general desire for a jewelry combination which is resistant to twisting and/or swaying of the pendant.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a jewelry combination comprising: a necklace; a pendant hanging from the necklace, wherein: the pendant comprises a body and a necklace guide mounted within the body: the necklace guide has a first side, a second side opposed to the first side, and a bearing surface extending from the first side to the second side; the necklace enters the body of the pendant, passes along the first side of the necklace guide, around the bearing surface of the necklace guide, along the second side of the necklace guide, and exits the body of the pendant; the bearing surface is configured to allow the necklace to freely slide around the necklace guide; a first strand having a first end attached to the pendant at a point along a first axis, wherein the first axis intersects the necklace where the necklace passes along the first side of the necklace guide; a second strand having a first end attached to the pendant at a point along a second axis, wherein the second axis intersects the necklace where the necklace passes along the second side of the necklace guide; and wherein the first axis is substantially parallel to the second axis.

Some embodiments of the necklace guide comprise: a base having a top surface and a bottom surface opposed to the top surface; and a projection extending from to the top surface of the necklace guide; wherein the projection defines the first side, second side and bearing surface of the necklace guide; and the necklace slides around the necklace guide by sliding around the projection.

Some embodiments comprise a jewelry combination wherein a first side of the projection defines the first side of the necklace guide; a second side of the projection defines the second side of the necklace guide; the projection has a rounded inside edge extending from the first side to the second side and defining the bearing surface; and the necklace slides around the projection by sliding along the first side, over the rounded inside edge, and along the second side of the projection.

Some embodiments comprise a jewelry combination wherein the pendant body defines a first necklace aperture and a second necklace aperture; the necklace enters the body of the pendant through the first necklace aperture; and the necklace exits the body of the pendant through the second necklace aperture.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

FIGS. 2E and 3F are respective partial top plan and partial bottom plan views of the jewelry combination depicted in FIG. 1.

DESCRIPTION

Figure 1:
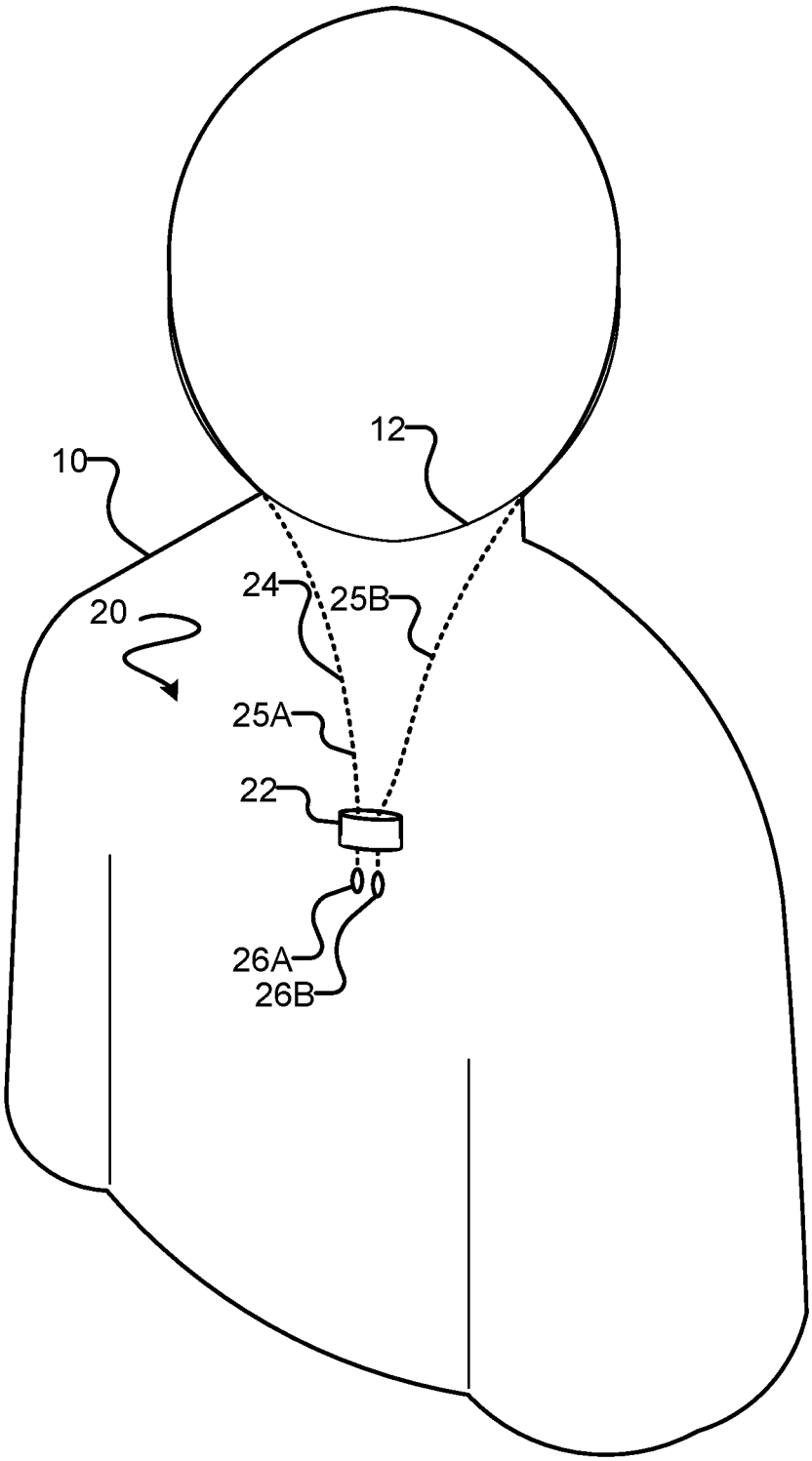
FIG. 1 depicts a jewelry combination according to an example embodiment of the present invention being worn by an individual.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Throughout this disclosure, the same reference numerals are used to indicate features and components that are similar between the embodiments.

Jewelry is frequently worn by individuals to adorn their bodies and clothing. In particular, pendants hung from necklaces are frequently worn for ornamental purposes.

Necklaces are closed loops of material worn around an individual's neck. Necklaces commonly comprise ornamental materials such as metal, fiber, and synthetic materials. Pendants are ornamental objects hung from necklaces. An individual may wear a combination of a necklace and a pendant (a jewelry combination) by wearing the necklace around their neck and hanging the pendant from the necklace.

A pendant according to the present invention may be intended to be worn in a certain orientation for ornamental and/or functional purposes. For example, the pendant may have a specific side, i.e. a "front" side, which is intended to face away from an individual wearing the pendant. The "front" side may have a particular design or ornamentation which is intended to be viewed by anyone observing the individual wearing the pendant.

As a further example, the pendant may have a certain side intended to be oriented towards an individual's face, i.e. a "top" side, and a certain side intended to be oriented away from the individual's face, i.e. a "bottom" side, when the individual wears the pendant. One reason for the pendant to be so orientated with a "top" and "bottom" may be to orientate the "front" side of the pendant. For example, the "front" side of the pendant may comprise a particular design or ornamentation which is intended to be viewed from a particular perspective by anyone observing the individual wearing the pendant.

As the pendant hangs from a necklace, the pendant may twist and sway as an individual wearing the necklace and pendant moves about. As the pendant twists and sways, the pendant may become tangled with the necklace. Furthermore, twisting and swaying of the pendant may cause the necklace to become tangled with itself. Maintaining the pendant in a certain orientation may reduce twisting and/or swaying of the pendant, thereby reducing tangling of the pendant with the necklace, and/or tangling of the necklace with itself.

Some embodiments of the present invention provide a jewelry combination comprising a necklace and pendant. In some embodiments, the pendant may be resistant to twisting and/or swaying. The pendant may be intended to be worn with a specific orientation, and the resistance of the pendant to twisting and/or swaying may maintain the pendant in the specific orientation.

One style of necklace and pendant jewelry combination is known as a lariat necklace. A lariat necklace comprises an open necklace strand worn around an individual's neck, and a pendant encircling both necklace strands and holding the necklace strands together. The pendant may hold the necklace strands through friction, or some form of attachment such as solder or glue. A lariat necklace is one type of necklace intended to be worn with a specific orientation.

Some embodiments of the present invention provide a lariat style jewelry combination. The jewelry combination may comprise a pendant hanging from a closed loop necklace, and two strands hanging from the pendant. The necklace, pendant and strands may be configured to appear to an observer as a single open-end necklace strand held by the pendant.

FIG. 1 depicts jewelry combination 20 according to an example embodiment of the present invention. Jewelry combination 20 is worn by individual 10. Jewelry combination 20 comprises pendant 22 hanging from necklace 24. Necklace 24 is worn around neck 12 of individual 10. Jewelry combination 20 may be resistant to twisting of pendant 22, and/or resistant to swaying of pendant 22. Jewelry combination 20 may appear to an observer as a single open-end necklace strand held by pendant 22.

When jewelry combination 20 is worn by individual 10, necklace 24 may move with movement of individual 10. For example, as individual 10 turns their head to a side, first side 25A of necklace 24 may be raised, and second opposing side 25B of necklace 24 may be lowered, as necklace 24 moves with turning of neck 12. As a further example, as individual 10 walks, their neck 12 may sway from side to side, and/or forward and back. As with individual 10 turning their head from side to side, individual 10 swaying their neck 12 from side to side respectively raises and lowers first side 25A and second side 25B of necklace 24. Furthermore, as individual 10 sways their neck 12 forward and back, necklace 24 may be pulled forward and back along with the swaying of neck 12.

The movement of necklace 24 resulting from the movement of individual 10 may cause one or more rotational and/or one or more linear forces on pendant 22. These forces tend to twist and/or sway pendant 22. Furthermore, the twisting and/or swaying of pendant 22 may tend to tangle pendant 22 with necklace 24, and/or tangle necklace 24 with itself.

Jewelry combination 20 attenuates one or more forces acting on pendant 22 resulting from movement of individual 10. Thereby, pendant 22 may be resistant to twisting and/or swaying due to movement of individual 10. The resistance of pendant 22 to twisting and/or swaying may maintain pendant 22 in a specific orientation.

Pendant 22 comprises a necklace guide internal to pendant 22. The necklace guide supports pendant 22 hanging from necklace 24, and necklace 24 freely slides through the necklace guide. By necklace 24 sliding through the necklace guide, pendant 22 attenuates one or more forces from necklace 24 acting on pendant 22.

In some embodiments, a center of mass of pendant 22 is lower than where necklace 24 passes through the necklace guide of pendant 22. The lower center of mass of pendant 22 may stabilize pendant 22 against twisting and/or swaying due to movement of necklace 24.

Jewelry combination 20 further comprises first and second strands 26A and 26B hanging from pendant 22.

The necklace guide may be configured so that first side 25A of necklace 24 appears to extend through pendant 22 and terminate with first strand 26A, and second side 25B of necklace 24 appears to extend through pendant 22 and terminate with second strand 26B. By appearing to be a single open-end strand of necklace passing through pendant 22 and held by pendant 22, jewelry combination 20 may appear as a lariat style necklace.

The necklace guide may comprise any structure by which pendant 22 may be hung from necklace 24, and which positions necklace 22 relative to pendant 22 where necklace 22 enters and exits the body of pendant 22. In some embodiments, the necklace guide may comprise:

- a passage through pendant 22 which necklace 24 passes through;
- a protrusion within the body of pendant 22 which necklace 24 passes around;
- a post within the body of pendant 22 which necklace 24 passes around; and/or
- a wheel within the body of pendant 22 which necklace 24 passes around.

Figure 2A:
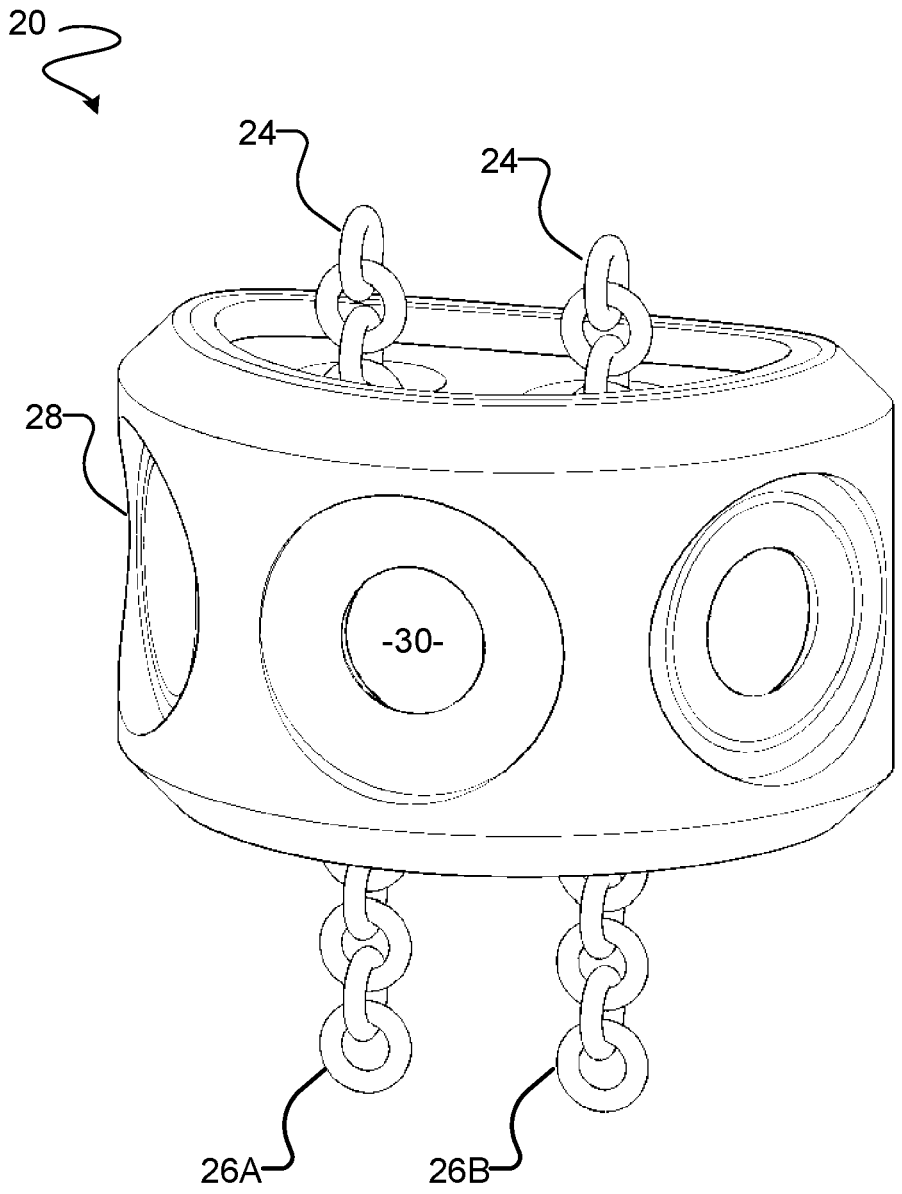
FIGS. 2A and 2B are respective partial front perspective and partial back perspective views of the jewelry combination depicted in FIG. 1.
Figure 2B:
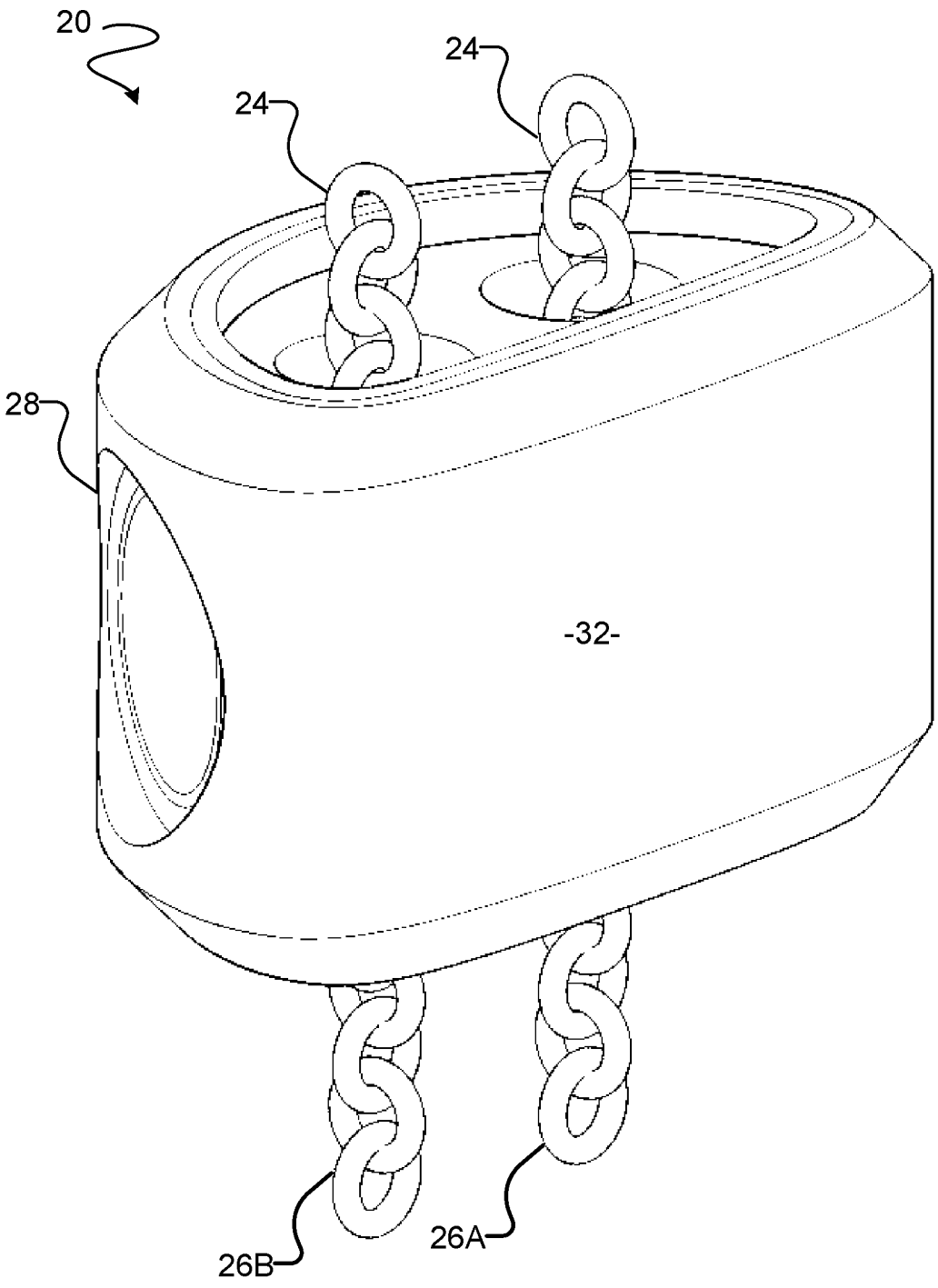

FIGS. 2A and 2B are respective partial front perspective and partial back perspective views of jewelry combination 20 depicted in FIG. 1. Pendant 22 comprises body 28. Body 28 has front surface 30 (depicted in FIG. 2A), and back surface 32 (depicted in FIG. 2B). Back surface 32 is opposed to front surface 30, and faces towards individual 10 when worn.

Front surface 30 may comprise an ornamental design. For example, front surface 30 may comprise one or more decorative ridges, engravings, and/or jewels. One or more portions of front surface 30 may be curved.

Back surface 32 may be configured to resist twisting of pendant 22. For example, back surface 32 may comprise a substantially flat portion to be worn against the body of individual 10. The substantially flat portion of back surface 32 may resist twisting of pendant 22 by resting against the body of an individual wearing pendant 22.

In some embodiments, back surface 32 may be substantially flat, and front surface 30 may extend from one side of back surface 32 to a second side of back surface 32.

Figure 2D:
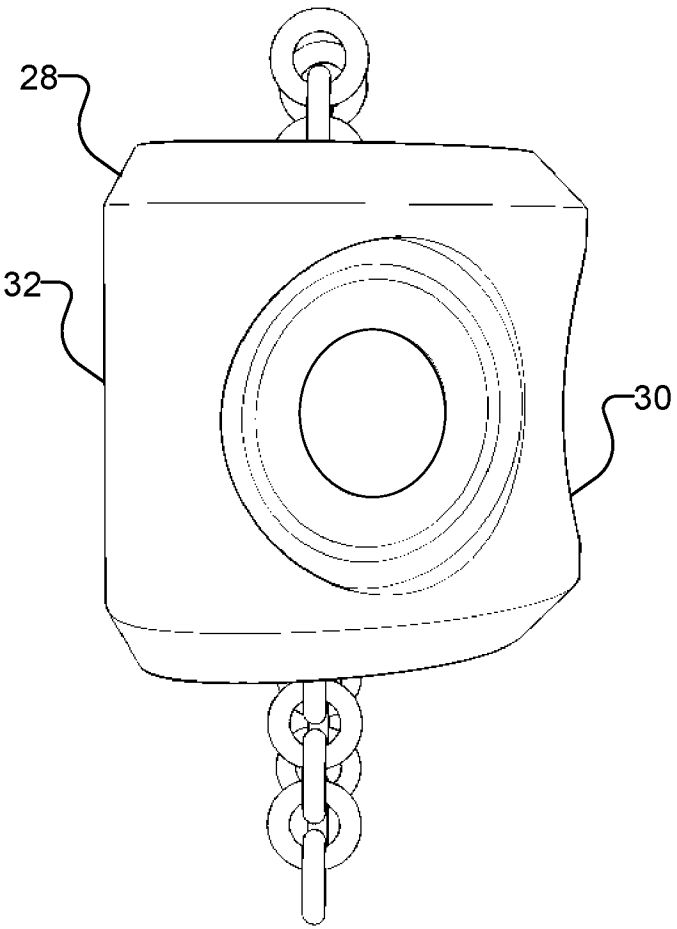
FIGS. 2C and 2D are respective partial front plan and partial side plan views of the jewelry combination depicted in FIG. 1.
Figure 2C:
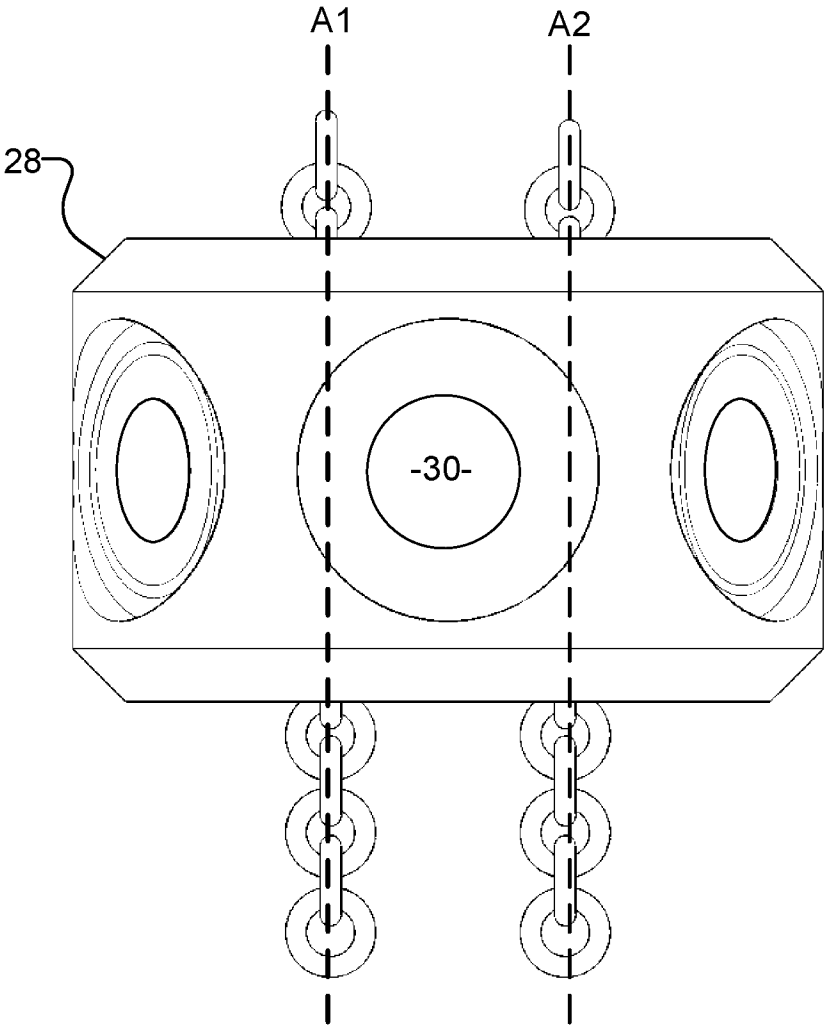

FIGS. 2C and 2D are respective partial front plan and partial side plan views of jewelry combination 20 depicted in FIG. 1.

Figure 2E:
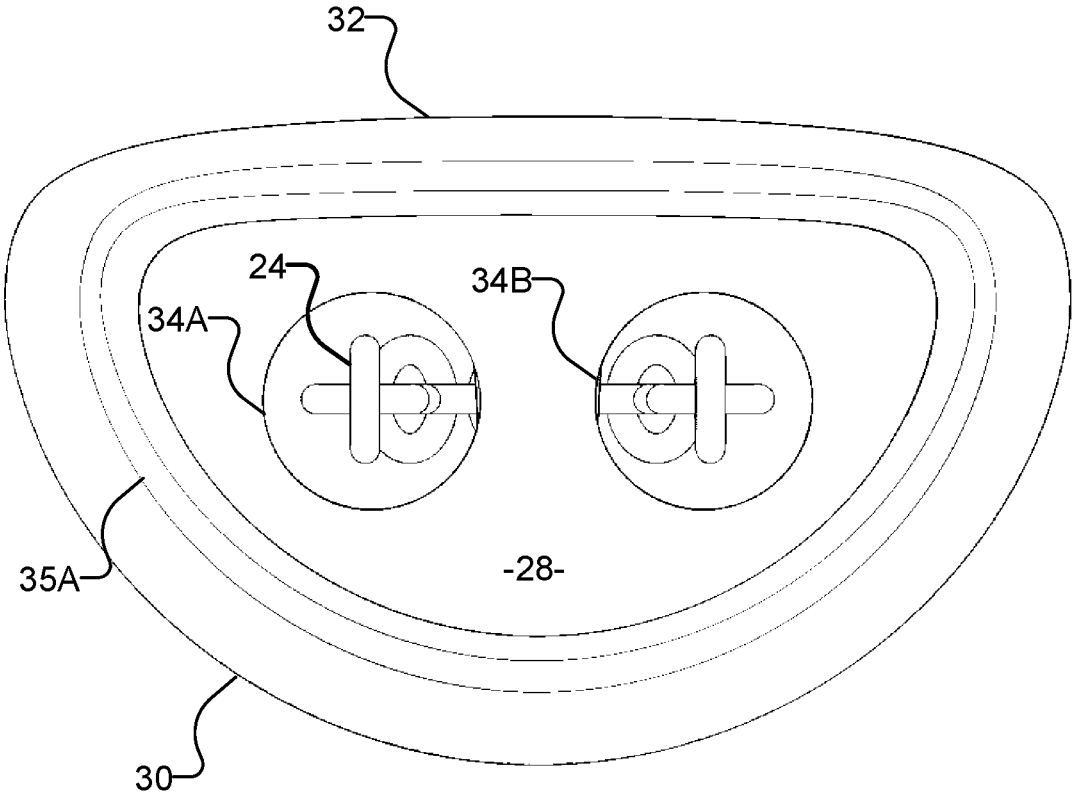
Figure 2F:
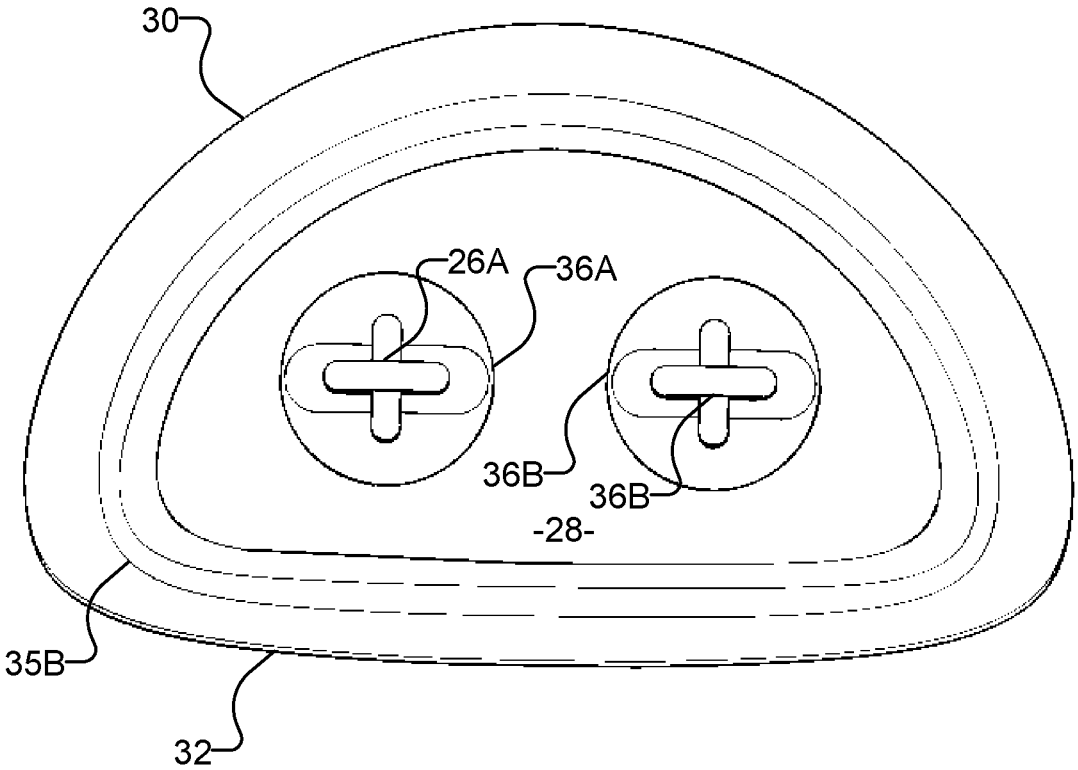

FIGS. 2E and 2F are respective partial top plan and partial bottom plan views of jewelry combination 20 depicted in FIG. 1.

In some embodiments, pendant body 28 defines first necklace aperture 34A and second necklace aperture 34B (depicted in FIG. 2E). In some embodiments, first and second necklace apertures 34A and 34B are substantially circular, and equal in diameter. In some embodiments, necklace 24 enters pendant body 28 through first necklace aperture 34A, passes through pendant body 28, and exits pendant body 28 through second necklace aperture 34B.

In some embodiments, pendant body 28 defines first strand aperture 36A and second strand aperture 36B (depicted in FIG. 2F). In some embodiments, first and second strand apertures 36A and 36B are substantially circular, and equal in diameter. First strand 26A may pass through first strand aperture 36A, and second strand 26B may pass through second strand aperture 36B.

First and second strand apertures 36A and 36B may be substantially equal in diameter to first and second necklace apertures 34A and 34B. First and second strand apertures 36A and 36B may be substantially parallel to first and second necklace apertures 34A and 34B. First strand aperture 36A may be substantially concentric with first necklace aperture 34A, and second strand aperture 36B may be substantially concentric with second necklace aperture 34B.

In some embodiments, first strand aperture 36A and first necklace aperture 34A are each centered about axis A1, and second strand aperture 36B and second necklace aperture 34B are centered about axis A2. Axis A1 may be substantially parallel with axis A2. One or both of axes A1 and A2 may be substantially parallel with a flat portion of back surface 32 of pendant 22.

In some embodiments, one or more of first necklace aperture 34A, second necklace aperture 34B, first strand aperture 36A, and second strand aperture 36B is recessed within body 28. Body 28 may have one or more ridges 35A surrounding one or more of first necklace aperture 34A and second necklace aperture 34B. Body 28 may have one or more ridges 35B surrounding one or more of first strand aperture 36A, and second strand aperture 36B.

In some embodiments, the pendant body may define a single necklace aperture. Where the pendant body defines a single necklace aperture, necklace 24 enters the pendant body through the single necklace aperture, passes through the pendant body, and exits the pendant body through the single necklace aperture.

In some embodiments, the pendant body may define a single strand aperture. Where the pendant body defines a single strand aperture, both first and second strands 26A and 26B may pass through the single strand aperture.

Where the pendant body defines a single necklace aperture and a single strand aperture, the single necklace aperture and the single strand aperture may be substantially circular, oblong, elliptical, or oval. The single necklace aperture and the single strand aperture may be substantially equal in diameter and/or concentric.

Figure 3A:
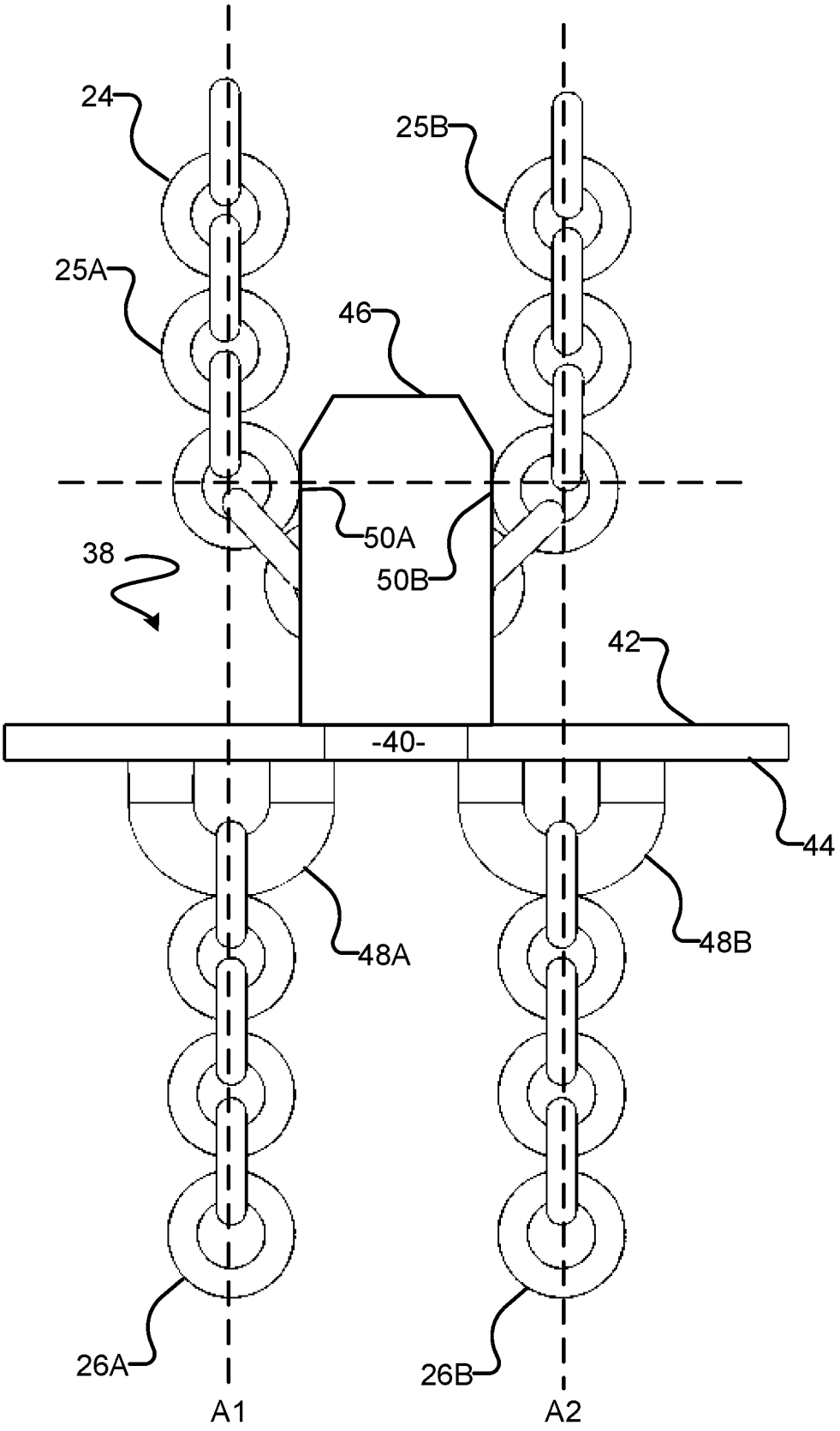
FIGS. 3A and 3B are respective front plan and side plan views of a necklace guide, necklace, first strand and second strand according to an example embodiment of the present invention.
Figure 3B:
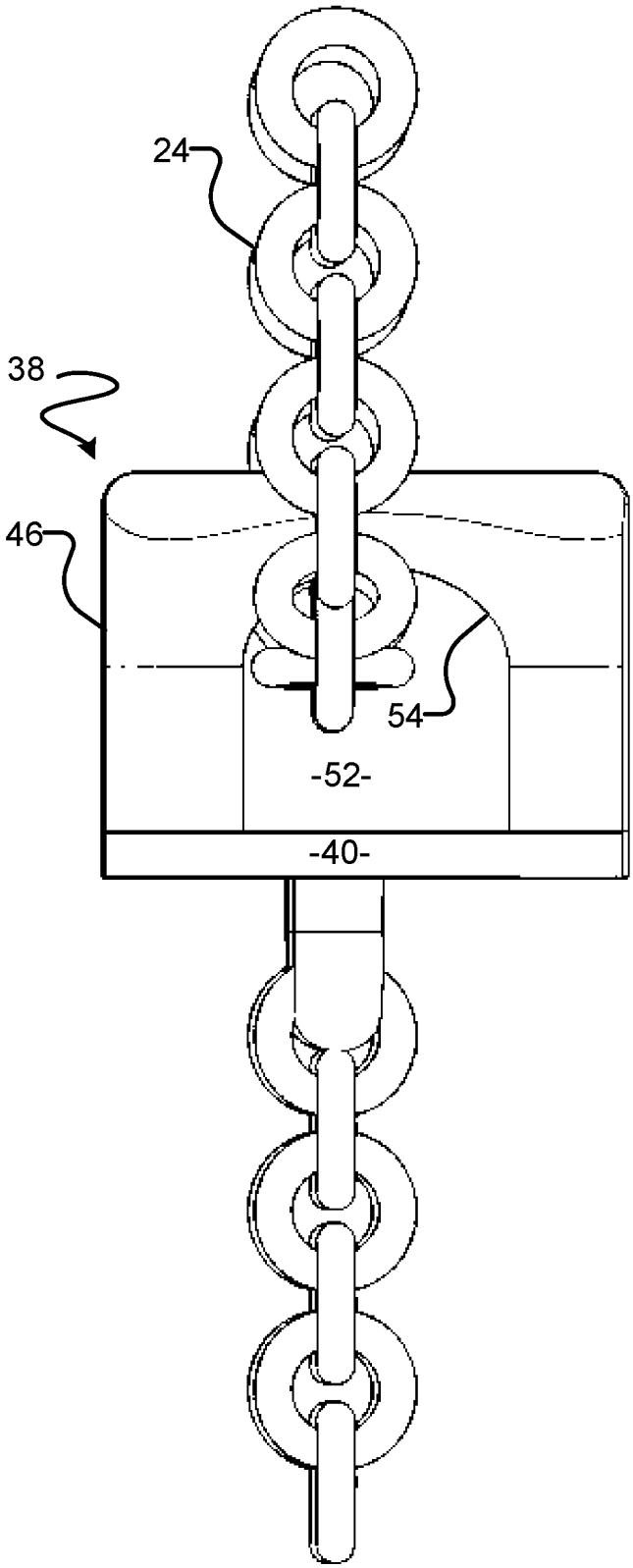

FIGS. 3A and 3B are respective front plan and side plan views of necklace 24 passing through necklace guide 38, and first and second strands 26A and 26B hanging from necklace guide 38. Necklace guide 38 may be mounted within pendant body 28, or integrally formed within pendant body 28.

Necklace guide 38 comprises base 40. Base 40 has top surface 42 and bottom surface 44. Bottom surface 44 is opposed to top surface 42. Projection 46 extends from top surface 42. First and second strand attachments 48A and 48B extend from bottom surface 44.

Projection 46 may be mounted to base 40, or integrally formed with base 40.

First and second strand attachments 48A and 48B may be mounted to base 40, integrally formed with base 40, or otherwise mounted to an inside of pendant body 28.

Projection 46 has first side 50A, second side 50B, and bearing surface 54. Second side 50B is opposed to first side 50A. Bearing surface 54 extends from first side 50A to second side 50B. Projection 46 defines aperture 52 (depicted in FIG. 3B). Necklace 24 passes along first side 50A, over bearing surface 54, and along second side 52B.

In some embodiments, bearing surface 54 comprises a rounded inside edge extending from first side 50A to second side 50B. Necklace 24 may slide through aperture 52 by sliding over the rounded inside edge of bearing surface 54. Rounded inside edge of bearing surface 54 may reduce friction between necklace 24 and necklace guide 38.

In some embodiments, aperture 52 is a U-shaped aperture, and necklace 24 passes through the U-shaped aperture and slides over a curved section of the U-shaped aperture.

In some embodiments, aperture 52 is between 1 and 5 millimetres in dimeter greater than a diameter of necklace 24.

Necklace 24 may freely slide through necklace guide 38 by freely sliding along first side 50A, over bearing surface 54, and along second side 50B. Necklace 24 may slide through necklace guide 38 because first side 25A of necklace 24 is pulled along axis A1 while second side 25B of necklace 24 is slack, or second side 25B of necklace 24 is pulled along axis A2 while first side 25A of necklace 24 is slack.

Freely sliding may mean that necklace 24 slides through necklace guide 38 when a first side of necklace 24 is raised by at least 1 centimeters and a second side of necklace 24 is slack.

For example, if first side 25A of necklace 24 is pulled along axis A1 away from necklace guide 38, necklace 24 may slide along second side 50B towards necklace guide 38, over bearing surface 54, and along first side 50A away from necklace guide 38. Similarly, if second side 25B of necklace 24 is pulled along axis A2 away from necklace guide 38, necklace 24 may slide along first side 50A towards necklace guide 38, over bearing surface 54, and along second side 50B away from necklace guide 38. By necklace 24 sliding through necklace guide 38, the transfer of force from necklace 24 to pendant 22 may be attenuated.

By attenuating transfer of force from necklace 24 to pendant 22, pendant 22 may be maintained in a certain orientation. For example, pendant 22 may be maintained with first strand 26A hanging substantially along axis A1, and second strand 26B hanging substantially along axis A2. Pendant 22 may be further maintained with necklace 24 passing along first side 50A and second side 50B, wherein necklace 24 intersects axis A1 where necklace 24 passes along first side 50A, and necklace 24 intersects axis A2 where necklace 24 passes along second side 50B.

First strand 26A may be coupled to first strand attachment 48A at a point along axis A1. First strand 26A may hang along axis A1, wherein axis A1 intersects necklace 24 where necklace 24 passes along first side 50A. Second strand 26B may be coupled to second strand attachment 48B at a point along axis A2. Second strand 26B may hang along axis A2, wherein axis A2 intersects necklace 24 where necklace 24 passes along second side 50B.

In some embodiments, axis A1 is substantially parallel with axis A2. One or both of axes A1 and A2 may be substantially orthogonal to one or both of first side 50A and second side 50B of necklace guide 28.

In some embodiments, first strand attachment 48A comprises a first U-shaped projection defining a first projection aperture; second strand attachment 48B comprises a second U-shaped projection defining a second projection aperture; the first projection aperture and the second projection aperture lie within a first plane; and the first plane is substantially orthogonal to one or both of first side 50A and second side 50B of necklace guide 28.

In some embodiments, aperture 52 lies within a second plane substantially orthogonal to one or both of first side 50A and second side 50B of necklace guide 28.

In some embodiments, first necklace aperture 34A and second necklace aperture 34B lie within a third plane substantially orthogonal to one or both of first side 50A and second side 50B of necklace guide 28.

Pendant 22 may have a center of mass below necklace guide 38. By having a center of mass lower than necklace guide 38, the force of gravity on pendant 22 may tend to stabilize pendant 22 as necklace 24 slides through necklace guide 38.

Pendant 22 may have a center of mass below where necklace 24 passes through aperture 52.

Figure 4A:
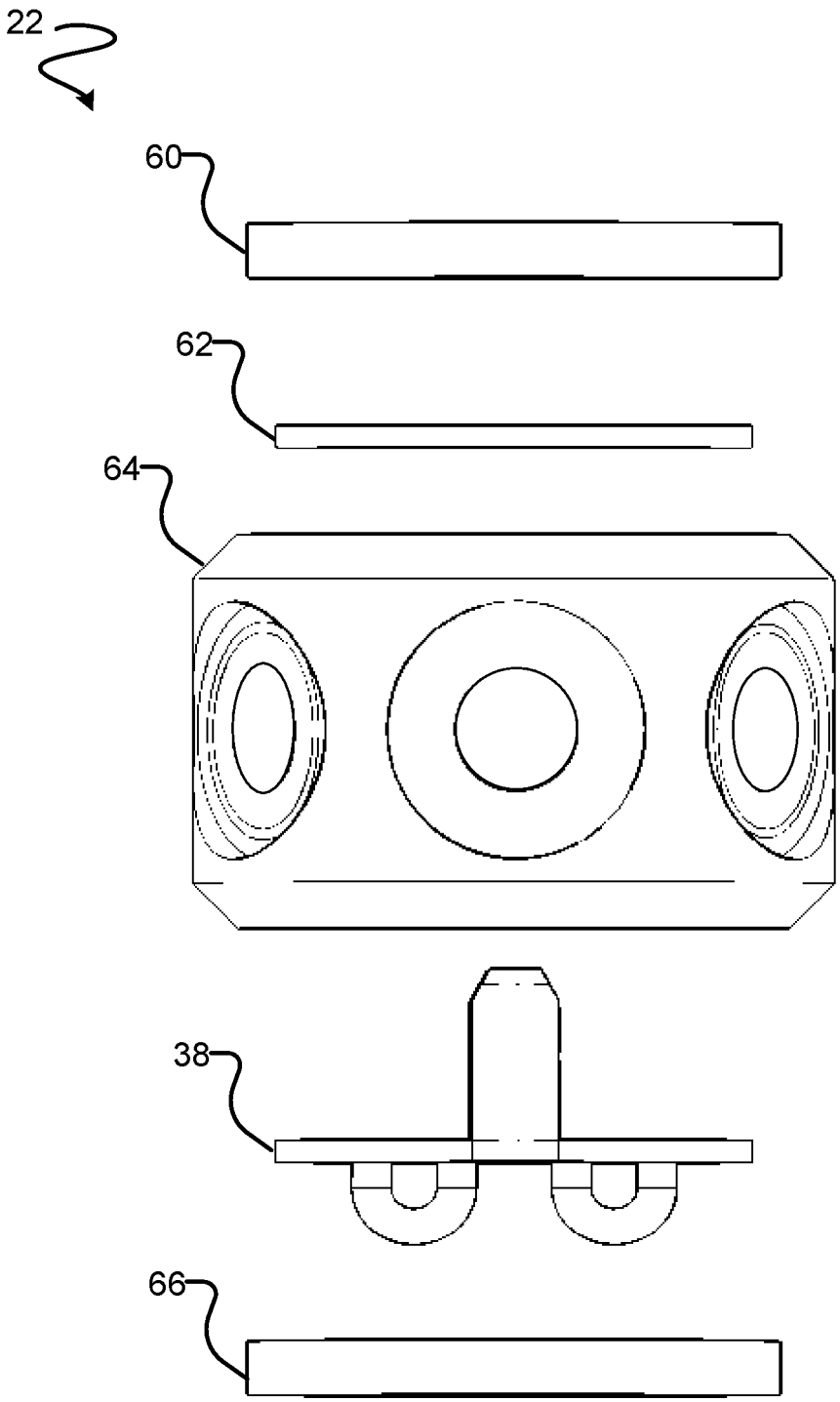
FIGS. 4A and 4B are respective front plan and side plan exploded views of a pendant according to an example embodiment of the present invention.
Figure 4B:
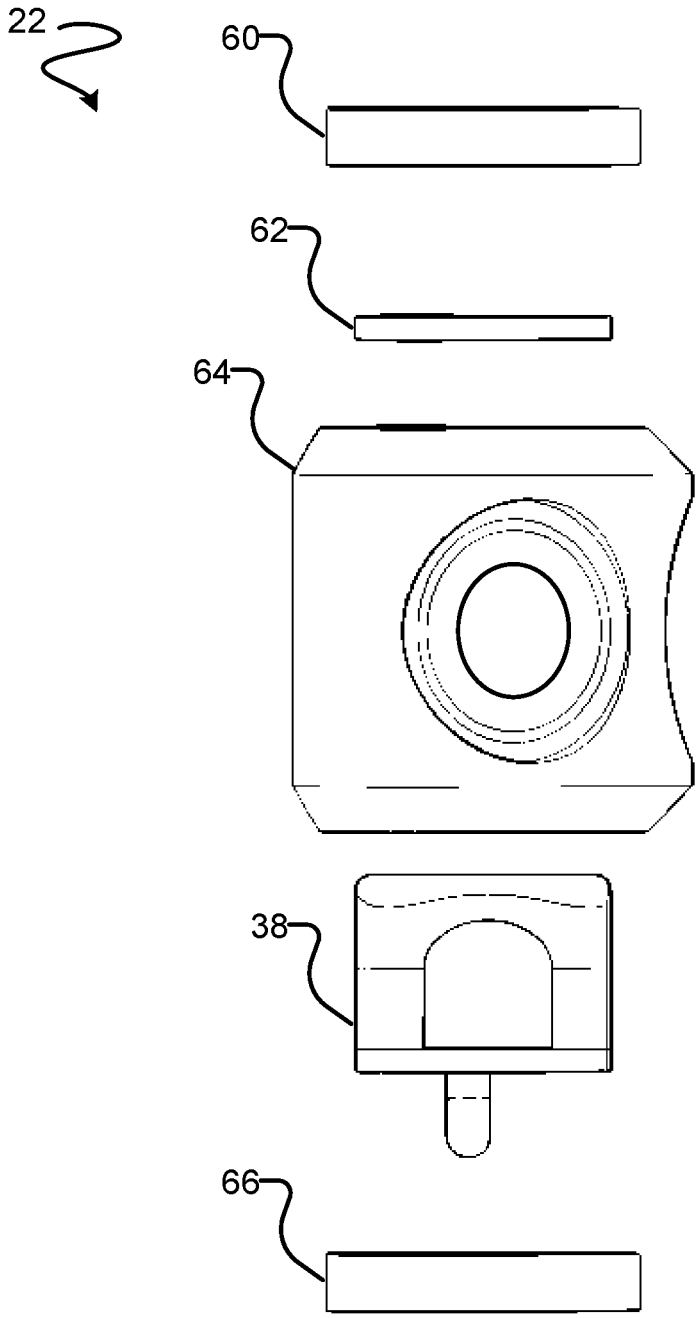

FIGS. 4A and 4B are respective exploded front plan and side plan views of a pendant according to an example embodiment of the present invention.

FIGS. 4A and 4B depict an embodiment of pendant 60 comprising body 28 and necklace guide 38. In the embodiment depicted in FIGS. 4A and 4B, body 28 comprises top member 60, spacer member 62, center member 64, and bottom member 66.

Top member 60 may define first and second necklace apertures 34A and 34B. Bottom member 66 may define first and second strand apertures 36A and 36B.

Top member 60 and bottom member 66 may be secured to center member 64 by friction fit or welding.

Spacer member 62 may be coupled between top member 60 and center member 64.

Figure 5:
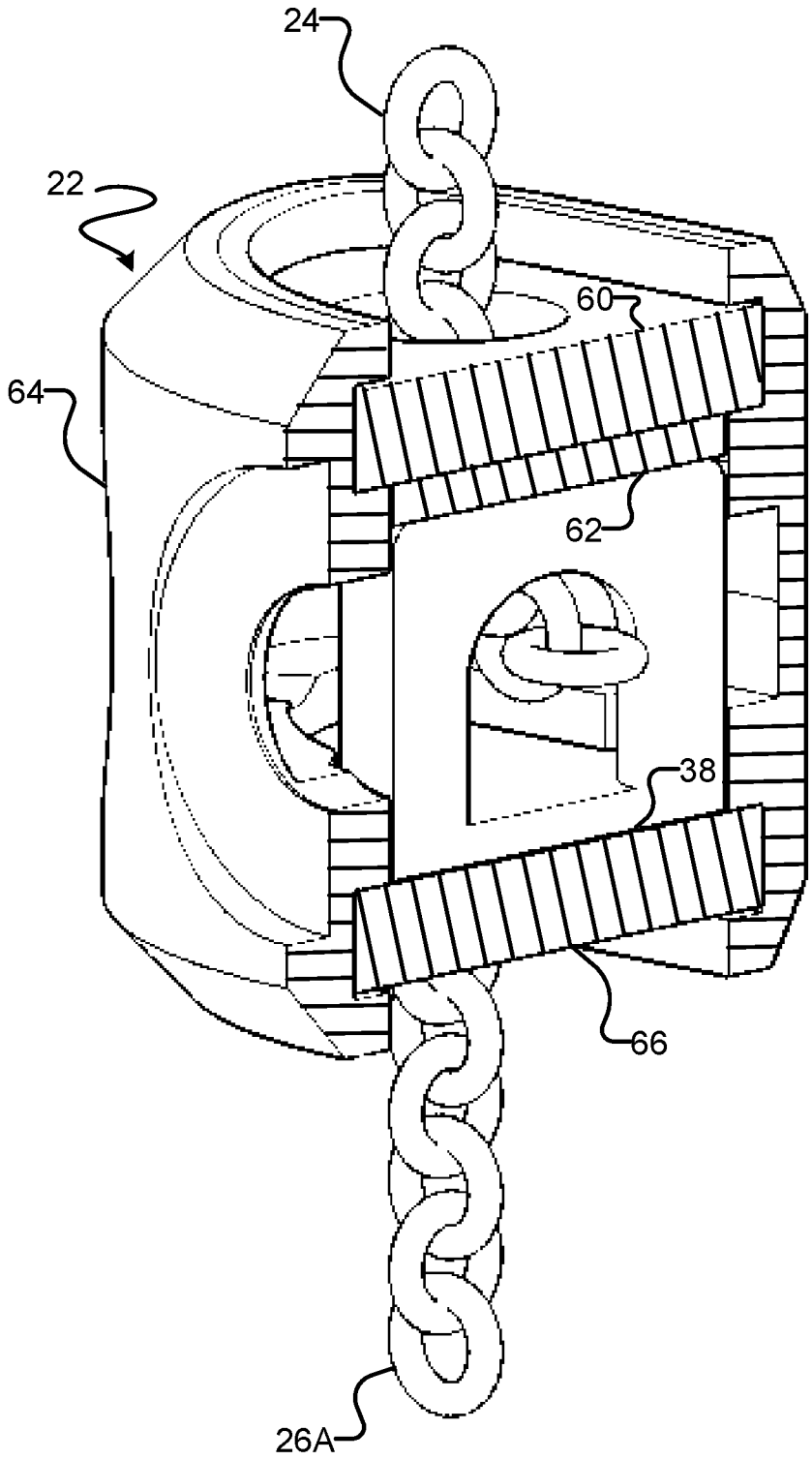
FIG. 5 is a partial cross-sectional view of a jewelry combination according to an example embodiment of the present invention.

FIG. 5 is a partial perspective cross sectional view of a jewelry combination according to an example embodiment of the present invention.

In some embodiments, necklace 24, first strand 26A, and second strand 26B each comprise a series of linked metal loops. Necklace 24, first strand 26A, and second strand 26B may comprise a series of substantially similar metal loops. For example, necklace 24, first strand 26A, and second strand 26B may each comprise a series of metal loops with a similar pattern of shape and/or color.

Necklace 24, first strand 26A, and second strand 26B may comprise a similar material and/or construction. For example, necklace 24, first strand 26A, and second strand 26B may comprise precious metal, or comprise a precious metal coating. Examples of precious metals include gold, silver and platinum.

Back side 32 of pendant 22 may be substantially orthogonal to one or more of first side 50A and second side 50B of necklace guide 28.

First and second strands 26A and 26B may be weighted to provide a stabilizing force to pendant 22 to further resist swaying and/or twisting of pendant 22 from force transferred to pendant 22 from necklace 24.

In some embodiments:

- necklace 24 is between 50 and 100 centimeters long;
- necklace 24 weighs between 100 and 200 grams;
- pendant 28 weighs between 50 and 100 grams;
- strands 26A and 26B are each between 5 and 15 centimeters long; and/or
- strands 26A and 26B each weigh between 10 and 20 grams.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a necklace, pendant, strand, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration.

These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

The invention claimed is:

1. A jewelry combination comprising:

a necklace;

a pendant hanging from the necklace, wherein:

the pendant comprises a body and a necklace guide mounted within the body:

the necklace guide has a first side, a second side opposed to the first side, and a bearing surface extending from the first side to the second side;

the necklace enters the body of the pendant, passes along the first side of the necklace guide, around the bearing surface of the necklace guide, along the second side of the necklace guide, and exits the body of the pendant;

the bearing surface is configured to allow the necklace to freely slide around the necklace guide;

a first strand having a first end attached to the pendant at a point along a first axis, wherein the first axis intersects the necklace where the necklace passes along the first side of the necklace guide;

a second strand having a first end attached to the pendant at a point along a second axis, wherein the second axis intersects the necklace where the necklace passes along the second side of the necklace guide; and wherein the first axis is substantially parallel to the second axis, wherein:

the necklace guide comprises:

a base having a top surface and a bottom surface opposed to the top surface; and a projection extending from the top surface of the necklace guide;

wherein the projection defines the first side, second side and bearing surface of the necklace guide; and the necklace slides around the necklace guide by sliding around the projection.

2. The jewelry combination according to claim 1, wherein:

a first side of the projection defines the first side of the necklace guide;

a second side of the projection defines the second side of the necklace guide;

the projection has a rounded inside edge extending from the first side to the second side and defining the bearing surface; and the necklace slides around the projection by sliding along the first side, over the rounded inside edge, and along the second side of the projection.

3. The jewelry combination according to claim 2, wherein:

the projection defines a U-shaped aperture with a curved section; and the necklace passes through the U-shaped aperture and slides over the curved section of the U-shaped aperture.

4. The jewelry combination according to claim 1, wherein:

the necklace guide comprises a first strand attachment and a second strand attachment extending from the bottom surface of the base of the necklace guide;

a first end of the first strand is attached to the first strand attachment; and a first end of the second strand is attached to the second strand attachment.

5. The jewelry combination according to claim 4, wherein:

the first strand attachment comprises a first U-shaped projection defining a first projection aperture;

the second strand attachment comprises a second U-shaped projection defining a second projection aperture;

the first projection aperture and the second projection aperture lie within a first plane; and the first plane is substantially orthogonal to the first side of the necklace guide.

6. The jewelry combination according to claim 1, wherein:

the pendant body defines a necklace aperture;

the necklace enters the body of the pendant through the necklace aperture; and the necklace exits the body of the pendant through the necklace aperture.

7. The jewelry combination according to claim 6, wherein the necklace aperture lies within a second plane substantially orthogonal to the first side of the necklace guide.

8. The jewelry combination according to claim 1, wherein:

the pendant body defines a first necklace aperture and a second necklace aperture;

the necklace enters the body of the pendant through the first necklace aperture; and the necklace exits the body of the pendant through the second necklace aperture.

9. The jewelry combination according to claim 8, wherein:

the first necklace aperture and the second necklace aperture lie within a third plane substantially orthogonal to the first side of the necklace guide.

10. The jewelry combination according to claim 1, wherein the necklace, the first strand, and the second strand each comprise a series of linked metal loops, wherein each of the metal loops is similar in shape and color.

11. The jewelry combination according to claim 10, wherein each of the metal loops comprises the same material.

12. The jewelry combination according to claim 1, wherein the pendant body has a flat back surface substantially orthogonal to the first side of the necklace guide.

13. The jewelry combination according to claim 1, wherein the pendant body has a decorative front surface.

14. The jewelry combination according to claim 1, wherein the necklace body covers the necklace guide.

15. The jewelry combination according to claim 1, wherein:

the first strand hangs substantially along the first axis; and the second strand hangs substantially along the second axis.

16. A jewelry combination comprising:

a necklace;

a pendant hanging from the necklace, wherein:

the pendant comprises a body and a necklace guide mounted within the body:

the necklace guide has a first side, a second side opposed to the first side, and a bearing surface extending from the first side to the second side;

the necklace enters the body of the pendant, passes along the first side of the necklace guide, around the bearing surface of the necklace guide, along the second side of the necklace guide, and exits the body of the pendant;

the bearing surface is configured to allow the necklace to freely slide around the necklace guide;

a first strand having a first end attached to the pendant at a point along a first axis, wherein the first axis intersects the necklace where the necklace passes along the first side of the necklace guide;

a second strand having a first end attached to the pendant at a point along a second axis, wherein the second axis intersects the necklace where the necklace passes along the second side of the necklace guide; and wherein the first axis is substantially parallel to the second axis;

wherein the pendant body defines a necklace aperture;

the necklace enters the body of the pendant through the necklace aperture; and the necklace exits the body of the pendant through the necklace aperture, wherein:

the pendant body defines a strand aperture;

the necklace aperture is concentric with the strand aperture; and the first strand and the second strand pass through the strand aperture.

17. The jewelry combination according to claim 16, wherein:

the necklace aperture has a first diameter;

the strand aperture has a second diameter; and the first diameter is substantially equal to the second diameter.

18. A jewelry combination comprising:

a necklace;

a pendant hanging from the necklace, wherein:

the pendant comprises a body and a necklace guide mounted within the body:

the necklace guide has a first side, a second side opposed to the first side, and a bearing surface extending from the first side to the second side;

the necklace enters the body of the pendant, passes along the first side of the necklace guide, around the bearing surface of the necklace guide, along the second side of the necklace guide, and exits the body of the pendant;

the bearing surface is configured to allow the necklace to freely slide around the necklace guide;

a first strand having a first end attached to the pendant at a point along a first axis, wherein the first axis intersects the necklace where the necklace passes along the first side of the necklace guide;

a second strand having a first end attached to the pendant at a point along a second axis, wherein the second axis intersects the necklace where the necklace passes along the second side of the necklace guide; and wherein the first axis is substantially parallel to the second axis;

wherein:

the pendant body defines a first necklace aperture and a second necklace aperture;

the necklace enters the body of the pendant through the first necklace aperture; and the necklace exits the body of the pendant through the second necklace aperture, wherein:

the pendant body defines a first strand aperture and a second strand aperture;

the first necklace aperture is concentric with the first strand aperture;

the second necklace aperture is concentric with the second strand aperture;

the first strand passes through the first strand aperture; and the second strand passes through the second strand aperture.

19. The jewelry combination according to claim 18, wherein:

the first necklace aperture has a first diameter;

the second necklace aperture has a second diameter;

the first strand aperture has a third diameter;

the second strand aperture has a fourth diameter; and the first, second, third and fourth diameters are substantially equal.

* * * * *